US009440343B2

(12) United States Patent
Herelier et al.

(10) Patent No.: US 9,440,343 B2
(45) Date of Patent: Sep. 13, 2016

(54) SPATIAL POSITIONING SAFETY INDIRECT SHOT ANCHORING DEVICE AND TELEACTUATING POLE FOR A SPATIAL POSITIONING SAFETY INDIRECT SHOT ANCHORING DEVICE

(75) Inventors: Patrick Herelier, Saint Jean de Muzols (FR); Emmanuel Vallon, Portes les Valence (FR); Ludovic Rousson, Saint Lager Bressac (FR)

(73) Assignee: SOCIETE DE PROSPECTION ET D'INVENTIONS TECHNIQUES SPIT, Bourg-les-Valence (FR)

( * ) Notice: Subject to any disclaimer, the term of this patent is extended or adjusted under 35 U.S.C. 154(b) by 993 days.

(21) Appl. No.: 13/509,079

(22) PCT Filed: Nov. 12, 2010

(86) PCT No.: PCT/IB2010/055152

§ 371 (c)(1),
(2), (4) Date: May 10, 2012

(87) PCT Pub. No.: WO2011/058523

PCT Pub. Date: May 19, 2011

(65) Prior Publication Data

US 2012/0223119 A1 Sep. 6, 2012

(30) Foreign Application Priority Data

Nov. 13, 2009 (FR) ..... 09 05478

(51) Int. Cl.

| | |
|---|---|
| ***B25C 1/18*** | (2006.01) |
| ***B25C 7/00*** | (2006.01) |
| ***B25C 1/14*** | (2006.01) |
| ***B25C 1/00*** | (2006.01) |

(52) U.S. Cl.

CPC ..... *B25C 1/008* (2013.01); *B25C 1/00* (2013.01); *B25C 1/14* (2013.01); *B25C 7/00* (2013.01)

(58) Field of Classification Search

CPC ..... B25C 1/00; B25C 1/008; B25C 1/14; B25C 1/18

USPC ..... 227/8, 18, 10, 140, 156; 173/18

See application file for complete search history.

(56) References Cited

U.S. PATENT DOCUMENTS

| | | | |
|---|---|---|---|
| 4,479,599 | A | 10/1984 | Conrad |
| 7,014,085 | B2 | 3/2006 | McCullough |
| 2005/0121487 | A1 | 6/2005 | Buechel et al. |

FOREIGN PATENT DOCUMENTS

| | | | |
|---|---|---|---|
| EP | 1498225 | A1 | 1/2005 |
| FR | 2860745 | A1 | 4/2005 |

OTHER PUBLICATIONS

Search Report corresponding to FR 0905478, dated Jul. 6, 2010.

*Primary Examiner* — Thanh Truong
*Assistant Examiner* — Dianne Mitchell
(74) *Attorney, Agent, or Firm* — Hauptman Ham, LLP

(57) ABSTRACT

The pole comprises a securing end, with device securing means and the device actuating means, a gripping end to be gripped by an operator and telecontrolling means for telecontrolling the actuating means. The actuating means are arranged in the device securing means and are directly controlled by the securing end of the pole and thus telecontrolled by the pole and its gripping end under the action of a thrust of the pole towards the support material. The device actuating means comprise safety means arranged to avoid by gravity the control of the actuating means by the securing end of the pole when the spatial position of the pole is inappropriate. The invention also relates to an anchoring device provided with the same safety means.

4 Claims, 6 Drawing Sheets

SPATIAL POSITIONING SAFETY INDIRECT SHOT ANCHORING DEVICE AND TELEACTUATING POLE FOR A SPATIAL POSITIONING SAFETY INDIRECT SHOT ANCHORING DEVICE

RELATED APPLICATIONS

The present application is a National Phase of International Application Number PCT/IB2010/055152, filed Nov. 12, 2010, and claims priority from, French Application Number 0905478, filed Nov. 13, 2009.

The field of invention of the present application is that of securing elements of nail or staple type by means of a hand actuated tool.

The hand actuating tool herein mentioned is of an anchoring or driving type for securing elements for an indirect shot, with a plunger propelled forwards under the action of the combustion of a powder charge or the explosion of a flammable gas blend, for driving a securing element.

In the case of an anchoring device, actuating means actuating the device trigger.

The use of such a device implies that it is arranged in abutment against the support material through its buffer guide, said abutment driving to the back part of the device the buffer guide that also forces backwards the device part, wherein a plunger, upon a shot, being propelled to the front part of the device, drives into the support material a securing element, previously introduced inside the buffer guide. The plunger of an indirect shot device is mounted on the gun of a powder loaded device or on a gas device cylinder.

The Applicant thus proposes an indirect shot driving device for securing elements provided with safety means convenient for its use in an appropriate spatial position.

To this end, the invention relates to an indirect shot device for driving securing elements into a support material, comprising a housing, wherein a securing element driving plunger is slidably mounted forwards under the action of the combustion of a propulsive charge caused by the control of actuating means of the device and upon which a buffer guide is mounted sliding backward through the abutment of the device against the support material to place the device in position of controlling the actuating means, a device characterized by the fact that it comprises safety means arranged to avoid by gravity the control of the actuating means when the spatial position of the device is inappropriate.

Thus, whereas the object of the device is to anchor securing means into the floor, a small bending of the axis thereof with respect to a vertical line will forbid the control of the actuating means. That is a so-called <<descending verticality>> safety. The device is a spatial positioning device with an abutment safety.

Advantageously, the safety means are arranged to avoid a sliding towards the back part of the buffer guide and thus the control of the actuating means.

In a preferred embodiment of the device according to the invention, the safety means comprise a casing, being integral with the housing, a drawer, being integral with the buffer guide and arranged to slide backwards in the casing, and a ball joint placed in a casing housing, with a leg engaged inside the drawer and pivotally mounted in the drawer under the action of its weight to avoid, in an inappropriate position of the device, for the drawer to slide inside the casing and thus the buffer guide to slide backwards.

Preferably, in the safety drawer there is arranged an annular shoulder, through which the ball joint leg is to pass upon the sliding of the drawer backwards when the device is in an appropriate spatial position and abuts against the ball joint leg, avoiding for the drawer to slide backwards, when the device is not in an appropriate spatial position.

Advantageously yet, the ball joint housing inside the safety casing is oblong and comprises, on its bottom, a receiving hole for a ball joint tail opposed to its leg so as to immobilize the ball joint by its tail and its leg, in case of a particularly dangerous position for the device, for instance when the buffer guide is directed upwardly.

The invention also relates to a pole for teleactuating an indirect shot device for driving securing elements into a support material, comprising a securing end, with securing means and actuating means for the device, a gripping end to be gripped by an operator, and telecontrolling means for telecontrolling said actuating means.

A teleactuating pole, being used to anchor securing elements into a support material remote from the operator and inaccessible for his device, even held at arm's length, as for instance a ceiling, aims at avoiding the operator to have to climb on a chair, a stool or other ladder, for being able to actuate his device in good stability and posture conditions.

Thus, the invention relates to a teleactuating pole for an indirect shot device for driving securing elements into a support material, to be placed in abutment against a support material, the pole comprising a securing end, with securing means and actuating means for the device, a gripping end able to be gripped by an operator, and telecontrolling means for telecontrolling the actuating means, the pole being characterized in that the actuating means are positioned in the device securing means and are arranged to be directly controlled by the pole securing end and thus to be telecontrolled by the pole and its gripping end under the action of a pole thrust towards the support material, and the device actuating means comprise safety means arranged to avoid by gravity the control of the actuating means by the pole securing end when the spatial position of the pole is inappropriate.

Preferably, the pole securing end is tubular, being arranged to be, in an appropriate spatial position of the pole, fit on a ball joint leg pivotally mounted in the securing means under the action of its weight.

The indirect shot device and the teleactuating pole belong to a same inventive concept. Indeed, and first of all, they give a solution to a same problem, which is to provide security during a shot of a securing element driving device, whether the device is hand held or secured at the end of a teleactuating pole. Then, it relates to a same solution, characterized by the same technical characteristics, that is the safety means which, by gravity, avoid the control of the device actuating means when the axial position thereof is not appropriate.

The invention will be better understood with the help of the following description of several embodiments of the invention, referring to the attached drawing, wherein.

Figure 1:
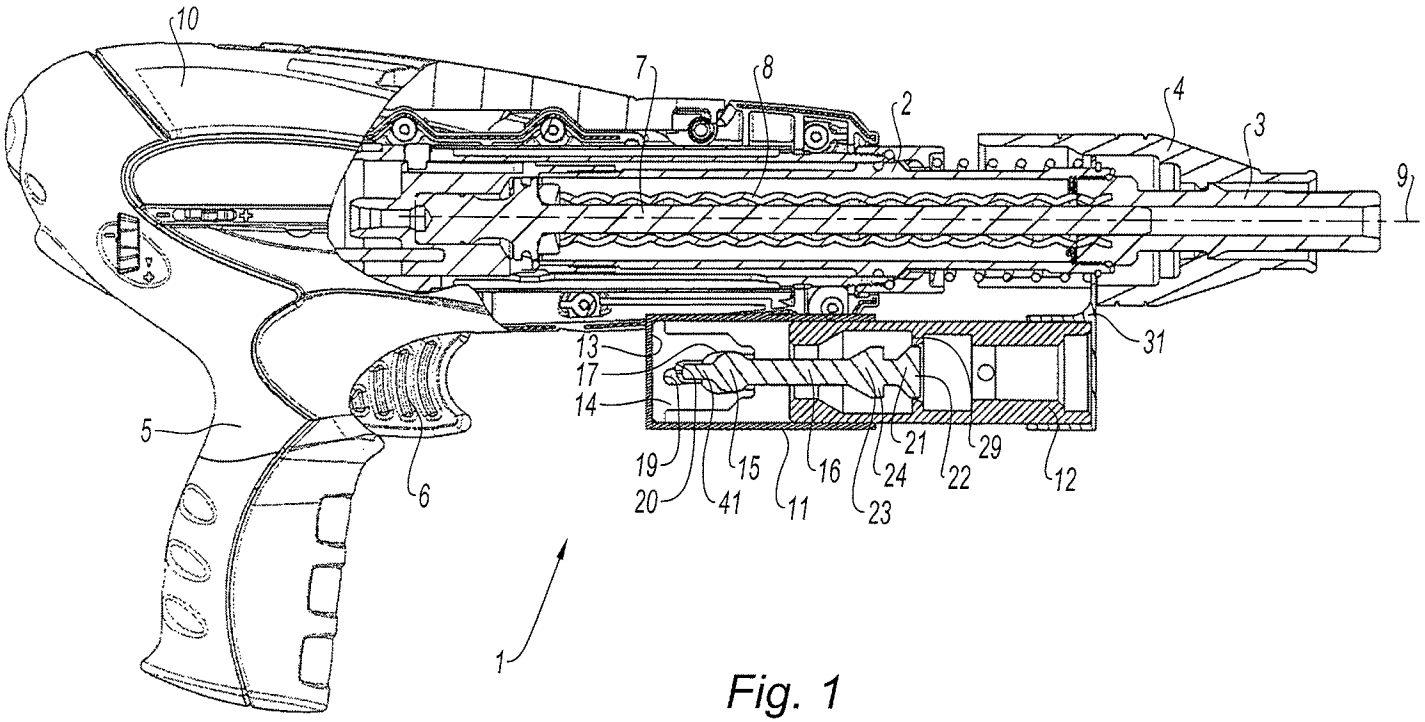
FIG. 1 is a view with a partial cut section of a securing element driving device, with a position safety casing, in an appropriate spatial position.
Figure 2:
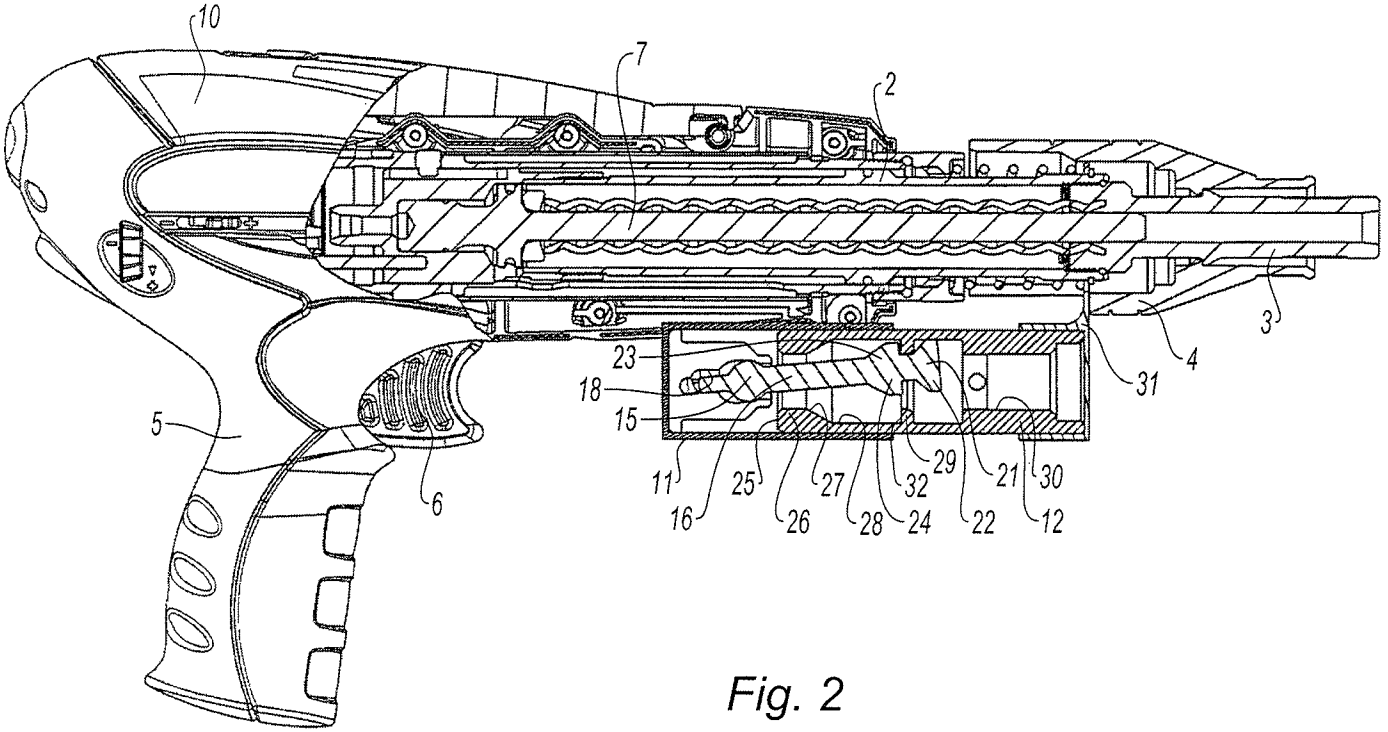
FIG. 2 is a view similar to that of FIG. 1, the device being in an inappropriate position but after a correct abutting start.
Figure 3:
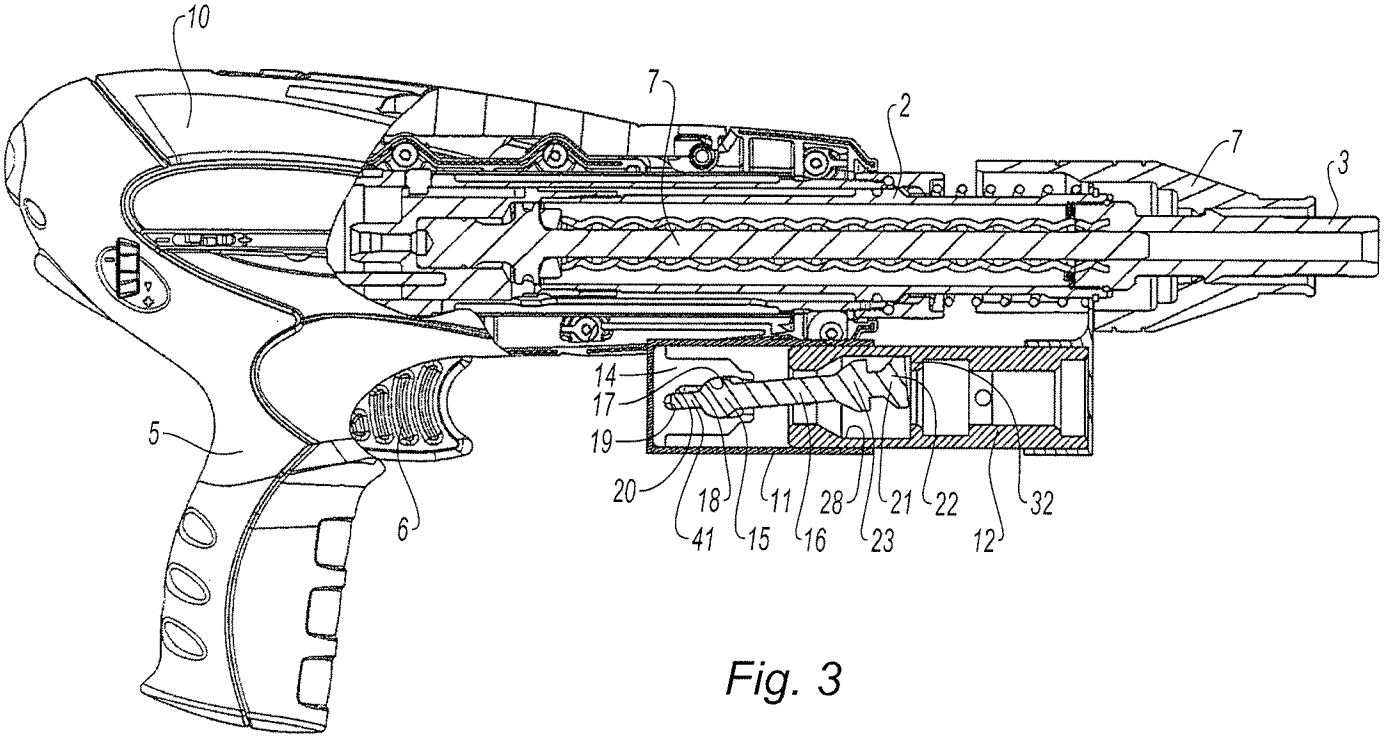
FIG. 3 is a view similar to that of FIGS. 1 and 2, of the device in a risky position.
Figure 4:
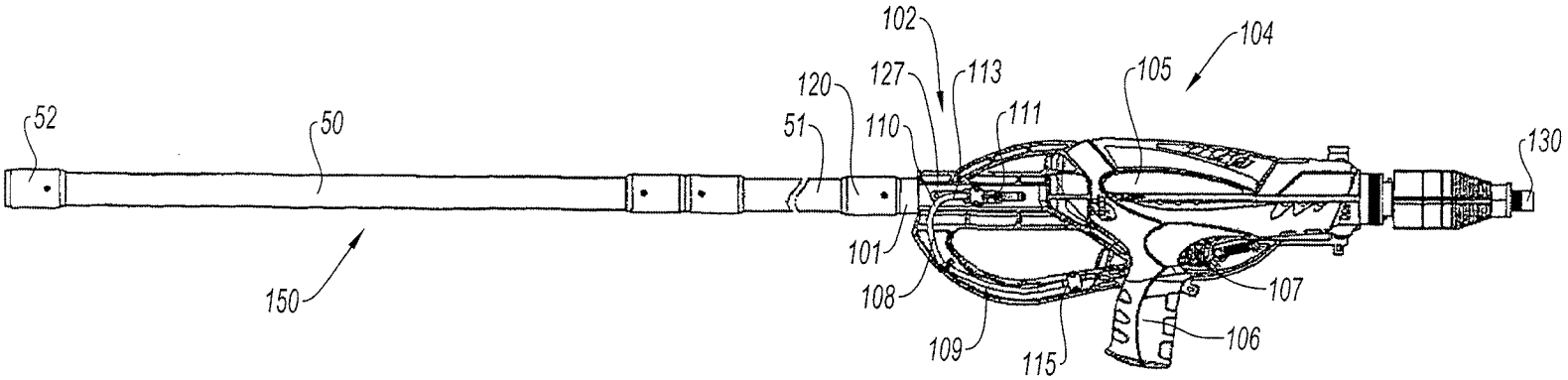
FIG. 4 is a view of the teleactuating pole, with its securing and actuating shoe and a securing device secured in the shoe, at rest.
Figure 5:
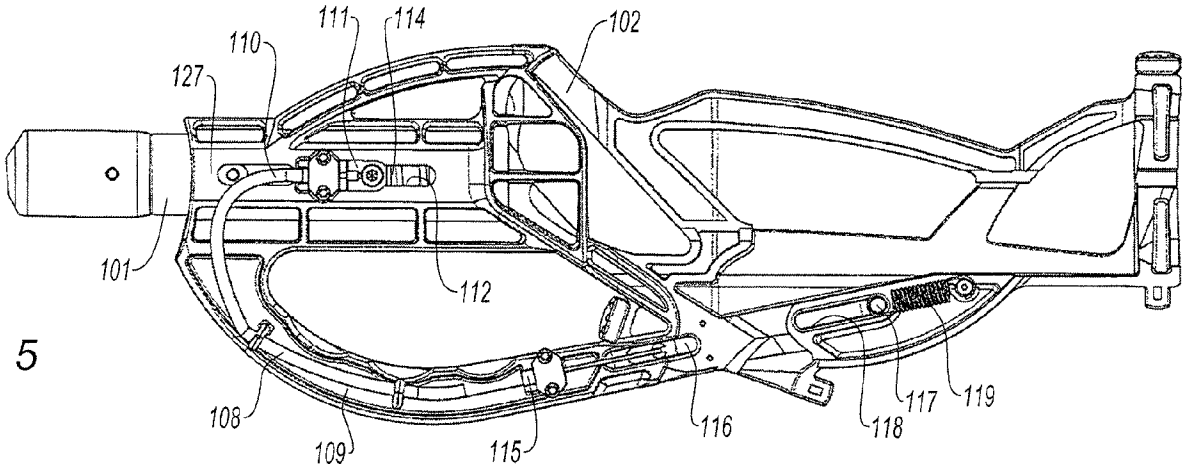
FIG. 5 is a more detailed view of the securing shoe of the pole of FIG. 4.
Figure 6:
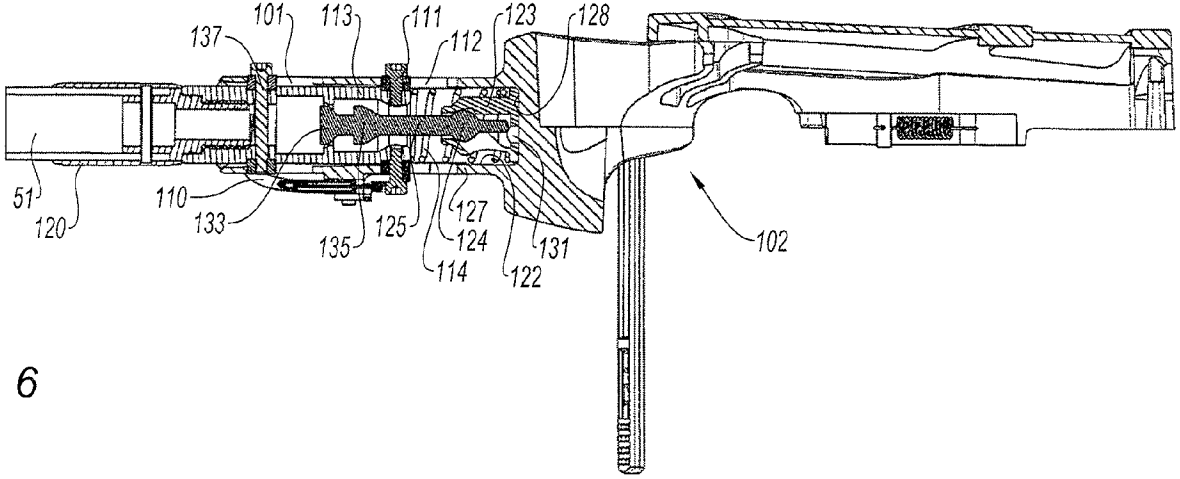
FIG. 6 is a detailed section axial view of the pole and its securing shoe, showing said actuating means in a vertical safety position of the pole, before the shot.
Figure 7:
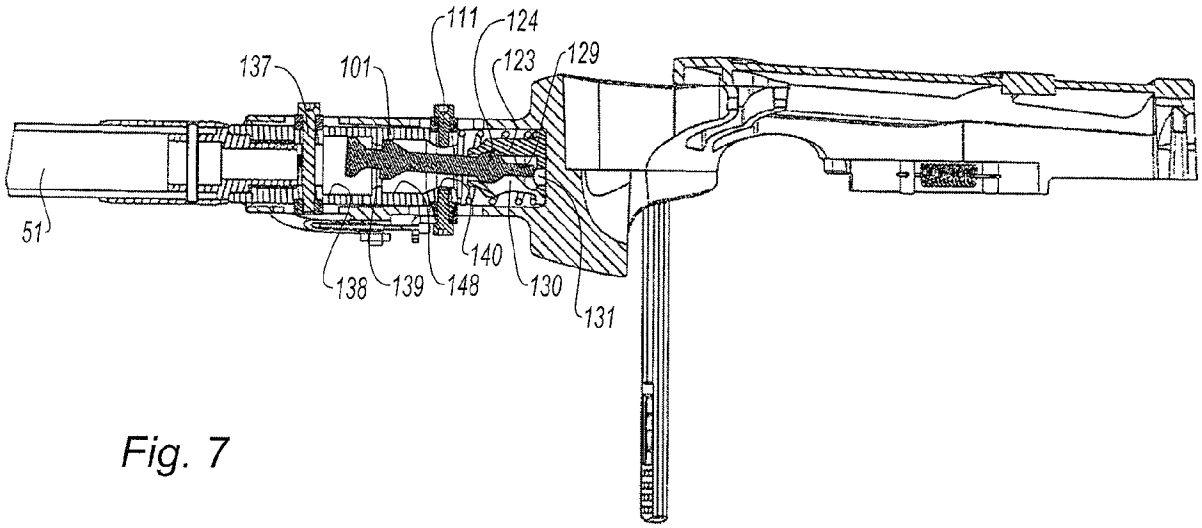
FIG. 7 is a view similar to that of FIG. 6, the pole being in an inappropriate position, but after a correct abutting start.

The device of FIGS. 1-3, herein a powder loaded device 1, comprises conventionally a housing 10, wherein a gun 2 extends, on the front of which a buffer guide 3 is secured, which extends in a support sleeve 4, being in translation integral with the buffer guide 3. The housing 10 is extended with a handle 5, on which an actuating trigger 6 is mounted. Within the gun 2 a driving plunger 7 extends, which, under the action of the combustion of a charge caused herein by a firing pin released by the actuation of the trigger 6, slides forwards, against the action of a return sleeve 8, to drive a securing means, previously introduced inside the buffer guide 3, into a support material.

To be able to actuate the trigger 6, the operator has to place the device in abutment against the support material, so as to force backwards the buffer guide 3 and the gun 2.

The invention comprises safety elements that ensure that this abutment is appropriately done, with the axis 9 of the device merging with a perpendicular to the support material surface against which the device abuts.

A safety casing 11, herein in parallelepiped shape, is secured under the housing 10, at the rear of the support sleeve 4 of the buffer guide 3. A safety drawer 12 is secured under the support sleeve 4; it also has a parallelepiped shape corresponding to the casing one, but in order to be able to slide in the casing during the abutment of the device. When the device is in an open position (FIG. 1), the rear of the drawer 12 is also fitted within the casing 11. On the back bottom 13 of the casing 11, a small pedestal 14 for holding a safety ball joint 15 which extends backwards by a small tail 41 and forwards by a leg 16, is arranged.

The pedestal 14 comprises an oblong housing 17, in which the ball joint 15 is arranged, the bottom of this housing comprising a staged hole 18 for receiving the tail of the ball joint 15. The hole 18 is staged and comprises here, between its communication opening with the housing 17 and its own bottom 19, a partial shoulder 20.

The ball joint leg 16 comprises a front frustoconical foot 21, being flared to the rear and with a calibrated end section 134. Slightly behind the foot 21, the leg 16 comprises a collar 23 also being frustoconical and with an end section 24 having the same size as the end section 22 of the foot 21.

The drawer 12 comprises (FIG. 2) a tortured bore, the section of which evolves from an end to the other. From the end 25 within the casing 11, the drawer bore comprises a first cylindrical part 26 having a path section corresponding to the ends 22 and 24 of the foot 21 and of the collar 23 in the ball joint leg 16. This cylindrical part 26 is followed by a frustoconical part 27 linked with a third cylindrical part 28 of a much bigger section to form a real recess.

This third part 28 is followed by a fourth thin and again cylindrical part 29, forming a narrowing of the same path section as the first part 26. At the front of this part, the bore extends with a tapped section 30 for securing the drawer 12 to a flange 31 secured to the support sleeve 4 of the buffer guide 3. The fourth and thin part 29 forming a narrowing presents, at the front bottom of the recess 28, a peripheral annular shoulder 32.

At rest, the foot 21 and the collar 23 of the ball joint leg 16 of the safety casing 11 are engaged within the recess 28 of the safety drawer 12 fitted into the casing 11.

When the device is abutted against the support material in an appropriate spatial position (FIG. 1), the axis 9 of the device being perpendicular to the material surface, the foot 22 and the collar 23 of the ball joint leg 16 can pass through the narrowing 29; the drawer 12 can slide in the casing 11 and the buffer guide 3 and the gun 2 can be forced backwards to position the device in shot position, before controlling the actuating trigger 6.

If the spatial position of the device is not appropriate (FIG. 3), by its weight, the ball joint leg 16 falls, the ball joint 15 rotates in its housing 17 and the foot 21, 22 comes against the recess wall 28. When the device is put in abutment, the foot 21, 22 abuts against the shoulder 32 of the narrowing 29, the ball joint tail 41, protruding from the shoulder 20 of the hole 18, is almost abutting against the bottom 19 of the hole 18, thus blocking the ball joint 15, by its tail 41 and its leg 16, in the so reached position, avoiding any continuation of the drawer 12 sliding inside the casing 11 and thus any continuation of the sliding to the back of the buffer guide 3 and the gun 2. The ignition becomes impossible.

It may happen that the operator has correctly positioned the device in abutment, that the foot 21, 22 of the ball joint leg 16 has been able to pass the narrowing 29, but that, for any reason, his attention has been wandering and that the device position became bad (FIG. 2).

Thus, as a double spatial positioning safety, the collar 23 by its end 24 abuts against the shoulder 32 at the recess bottom 28, avoiding the continuation of the drawer 12 sliding inside the casing 11 and that of the buffer guide 3 and the gun 2 to the back of the device.

The teleactuating pole will be described by now.

The pole 150, that is to be described, can be integral with or, as in the present case, comprise a plurality of lengths 50, 51, . . . linked together and assembled end to end, here through screwing. The pole comprises a gripping end 52, to be gripped by an operator, and a securing end portion 101 mounted to slide in a securing and actuating shoe 102, being shaped to receive, the case being, an anchoring device 104, engaged in appropriate recesses of the shoe.

The tool 104 conventionally comprises a body 105, a handle 106 and at the junction of both, a trigger 107. Its tip guide 130, at the front, aims to be abutted against the support material in order to be able to perform a shooting.

The tool trigger 107 actuating is performed by means, here, of a traction cable 108. The cable extends in a groove 109 of the shoe 102. One of the ends 110 of the cable 108 is secured to a small yoke 111 which is itself, through an oblong lumen 112 arranged in part 127 of the shoe 102 within which the pole securing end portion 101, secured to the end 113 of this end portion 101. This pole securing end portion 101 can slide towards the front part of the device against the action of a return spring 114. The other of the ends 115 of the cable 108 is secured to an actuating length 116 having a finger 117 for actuating the trigger 107. The length 116 can slide in the groove 118 in the opposed direction at the front of the tool 104 under the action of a traction cable 108 and against the action of a spring 119, intended to bring back the finger 117 and the length 116 to the front of the device 104, as well as against the action of the spring 114.

The pole securing end portion 101 is a tubular sleeve in which there is herein screwed the last length 51 of the pole which is covered, in its part adjacent to the sleeve 101, with an anti-expansion hoop 120.

The end 113 of the pole end sleeve 101 is slidably mounted in a blind bore 122 arranged in the part 127 of the shoe 102. In the bottom 128 of this bore 122 a small pedestal 123 is arranged for holding a safety ball joint 124 extended by a leg 125 ending by a foot 133 able to be introduced inside the end 113 of the pole sleeve 101.

The ball joint 124 is located in a recess 129 of the pedestal 123, one of its walls 130 allowing a relatively high mobility of the ball joint within its housing. The bottom of the recessed pedestal 123 comprises a hole 131, the function of which will appear later.

The ball joint 124 extends, forwards, by a small tail 141 and, backwards, by a leg 132. The ball joint leg 132 comprises a back frustoconical foot 133 which is flared to the rear and with a calibrated end section 134. Slightly ahead of the foot 133, the leg 132 comprises a collar 135 being also frustoconical and with an end section 136 having the same size as the end section 134 of the foot 133.

The end sleeve 101 comprises a tortured section inner bore evolving from an end to the other. From the ring 137, surrounding the sleeve 101 at right angle with the end of the threaded portion in the length 51, the inner bore of the sleeve 101 comprises a first cylindrical part 138. This part is followed by a thin cylindrical part 139 forming a narrowing, the path section of which corresponds to the ends 134, 136 of the foot 133 and of the collar 135.

Beyond the narrowing 139, the inner bore of the sleeve 101 is followed by a cylindrical part 148. The yoke 111 forms a second narrowing 140, ahead of the first one 139. Beyond and forward, the cylindrical part 148 extends by the blind bore 122 of the part 127 of the shoe 102, in which the pedestal 123 and the spring 124 partially arranged around the pedestal 123 and abutting against the bottom 128 of the bore 122 and the yoke 111 are located.

The pole end sleeve 101, on one hand, and the cable 108 and the length 116, with its finger 117, on the other hand, all these means being arranged in the securing shoe 102, constitute the actuating means of the trigger 107 in the device 104. They are directly controlled by the element 51 of the pole and thus by its gripping end 52 simply by thrust of this pole towards the front of the device, and thus towards the support material against which the device is abutting while shooting, a thrust leading to the sliding of the sleeve 101 inside the bore 122 of the securing shoe 102, against the action of the spring 114. The yoke 111 being thus driven towards the front of the device, drives the end 110 of the cable 108 and thus the cable 108, thus slidably pulling the length 116 inside the groove 118, in a direction opposed to the front of the device, against the action of the return spring 119, which moves the finger 117 actuating the trigger 107.

The actuating means, the operation of which has just been described, are associated with safety means comprising the ball joint 124, with its leg 125, its foot 133 and its collar 135.

The safety operation of the pole 150 is identical to that of the device 1.

When the pole 150 extends vertically, its securing shoe 102 correctly positioned towards a ceiling or abutting against a ceiling, the ball joint 124 is well centred on its pedestal 123 with its leg 125 also extending vertically. In that appropriate position, the pole can thus be pushed, after an abutment with the device, to actuate the trigger 107, the sleeve 101 correctly fitting on the foot 133 and the collar 135 of the ball joint leg 125 passing through the narrowing 139, the sleeve 101 thus fitting well in the shoe part 127 and the yoke 111 sliding inside the lumen 112, to pull the end 110 of the cable 108 forward.

It should be noted that at rest, the foot 133 and the collar 135 of the ball joint leg 125 are located inside the cylindrical boring part 148 of the sleeve 101.

If the spatial position of the pole 150 is not good, by gravity (the leg weight), the leg 125 of the ball joint will pivot by rotating the ball joint 124 in its housing 129 of the pedestal 123.

Figure 8:
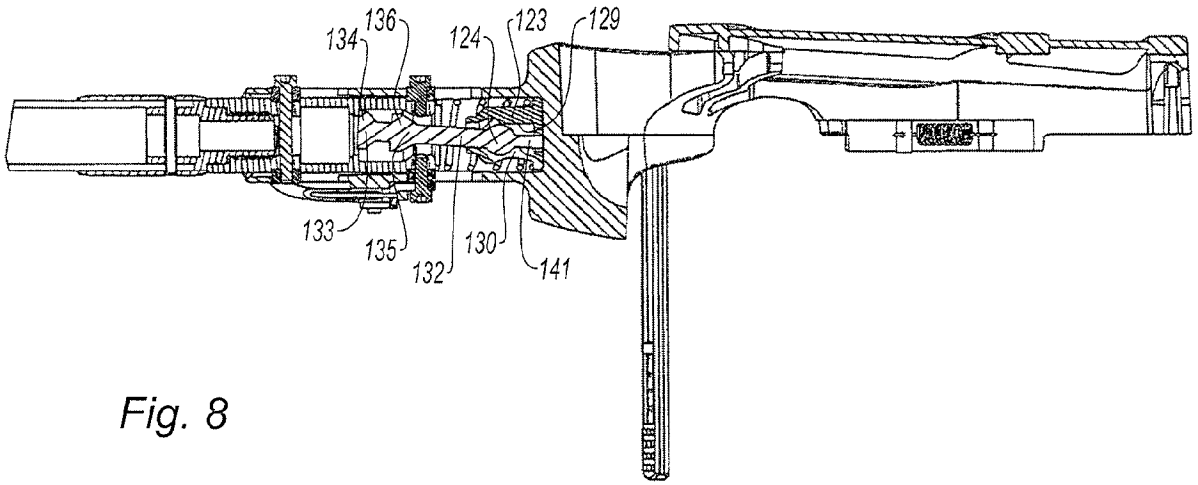
FIG. 8 is a view similar to that of FIGS. 6 and 7, the pole being in very bad position.

When the device is abutted, the foot 133 comes against the annular shoulder formed by the narrowing 139 (FIG. 8), avoiding any continuation of sliding of the sleeve 101 in the part 127 of the shoe 102 and thus any traction on the cable 108; actuating the trigger 107 is impossible.

As with the device 1 being hand hold, if the spatial position of the pole becomes bad after a good application start, during which the foot 133 could pass the narrowing 139, the collar 135, by its end 136, abuts against the shoulder formed by the narrowing 139, avoiding the continuation of the sleeve 101 sliding inside the shoe 102 and thus the actuation of the trigger 107. This is a double spatial positioning safety.

In case of a particularly dangerous pole position, for instance when the pole is not directed upward, towards a ceiling, the ball joint 124 rotates in its housing and its tail 141 is pushed inside the hole 131 in the bottom of the pedestal 123 and the foot 133 abuts against the shoulder 139, to immobilize the ball joint and avoid any sliding of the sleeve 101.

The invention claimed is:

1. An indirect shot device for driving securing elements into a support material, comprising a housing, wherein a securing element driving plunger is slidably mounted forwards under the action of the combustion of a propulsive charge by the control of actuating means in the device and upon which a buffer guide is mounted sliding backward by abutting the device against the support material to locate the device in a controlling position for the actuating means, the device characterized by the fact that it comprises safety means arranged to avoid by gravity the control of the actuating means when the spatial position of the device is inappropriate, wherein the safety means are arranged to avoid the sliding towards the back of the buffer guide and thus the control of the actuating means, and wherein the safety means comprise a casing, being integral with the housing, a drawer, being integral with the buffer guide and arranged to slide backwards in the casing, and a ball joint arranged in a second housing of the casing, with a leg engaged inside the drawer and pivotally mounted in the drawer under the action of its weight to prevent, in an inappropriate spatial position of the device, the sliding of the drawer inside the casing and thus the sliding of the buffer guide backwards.

2. A device according to claim 1, wherein there is arranged inside the drawer an annular shoulder, through which the leg is to pass upon the sliding of the drawer backwards when the device is in an appropriate spatial position and abuts against the leg, preventing the drawer sliding backwards, when the device is not in an appropriate spatial position.

3. A device according to claim 2, wherein the leg comprises a foot and a collar, backwards the foot, to abut, by gravity, against the annular shoulder and thus provide a double spatial positioning safety.

4. A device according to claim 1, wherein the ball joint housing in the safety casing is oblong and comprises a hole for receiving a ball joint tail opposed to its leg so as to immobilize the ball joint by its tail and its leg, in case of a particularly dangerous position of the device.

* * * * *